US005555639A

United States Patent [19]

Livingston et al.

[11] Patent Number: 5,555,639

[45] Date of Patent: Sep. 17, 1996

[54] ROTARY DRUM DRYER

[75] Inventors: Jeffrey T. Livingston, Neodesha; Andrew D. Livingston, Independence, both of Kans.

[73] Assignee: Productization Inc., Independence, Kans.

[21] Appl. No.: 443,682

[22] Filed: May 18, 1995

[51] Int. Cl.[6] ..... F26B 11/02

[52] U.S. Cl. ..... 34/135; 34/136; 34/137; 34/166; 34/599

[58] Field of Search ..... 34/135, 136, 137, 34/138, 599, 166, 167, 176

[56] References Cited

U.S. PATENT DOCUMENTS

| | | | |
|---|---|---|---|
| 857,161 | 6/1907 | Cummer | 34/137 |
| 953,653 | 3/1910 | Willson | 34/137 |
| 1,173,188 | 2/1916 | Hetherington | 34/137 |
| 1,255,843 | 2/1918 | Adt | 34/137 |
| 1,358,313 | 11/1920 | Hero | 34/136 |
| 2,132,972 | 10/1938 | Schmidt | 34/136 |
| 3,571,944 | 3/1971 | Duhem | 34/136 |
| 3,704,873 | 12/1972 | Jensen | 34/135 |
| 4,026,678 | 5/1977 | Livingston | 44/10 |
| 4,346,523 | 8/1982 | Ronning | 34/137 |
| 4,376,343 | 3/1983 | White et al. | 34/136 |
| 4,696,116 | 9/1987 | Livingston | 34/108 |
| 4,729,176 | 3/1988 | Shinn et al. | 34/33 |
| 4,802,288 | 2/1989 | Shinn et al. | 34/136 |
| 4,894,930 | 1/1990 | Shinn | 34/136 |

*Primary Examiner*—John T. Kwon

*Attorney, Agent, or Firm*—Hovey, Williams, Timmons & Collins

[57] ABSTRACT

An anti-clogging rotary drum dryer for drying stranded material is provided which includes a tubular, rotatable housing having an inlet for receiving drying gas and wet material, as well as first and second, apertured, telescopically interfitted tubes within the housing and defining the dryer flow path. The first and second tube apertures are designed for passage of the stranded material without clogging, and filler and lifting flight structure is provided within the dryer for assuring smooth, trouble-free operation.

19 Claims, 3 Drawing Sheets

ROTARY DRUM DRYER

BACKGROUND OF THE INVENTION

1. Field of the Invention

The present invention relates to a rotary dryer used for drying material by passing a mixture of an inlet gas and the material from an inlet and along a material flow path through the dryer and to an outlet. More particularly, the rotary drum dryer hereof has an improved structure which prevents the clogging of the material flow path during operation.

2. Description of the Prior Art

Presently, material, such as wheat straw, long strand alfalfa, wood seltzer, and other elongated strands of material, are dried by being mixed with gas and injected into a rotary dryer having an inlet and an outlet. Once the material reaches the outlet, it is sufficiently dry for use.

It is known in the prior art to provide a rotary dryer for drying material which includes a tubular housing presenting first and second ends, and having first and second tubes mounted in a concentric relationship within the housing. A mixture of inlet gas and material is introduced into the housing, and flows through a material flow path defined by the path extending from the housing into and through the first tube, into and through the second tube, and to an outlet.

The first tube of the prior art presents a first end, and an open second end. A first end plate is mounted to the first tube adjacent to the first tube first end. A second end plate is mounted to the housing adjacent to the housing second end. The first end of the first tube is supported by pedestals extending radially from the housing to the first tube first end. The second end of the first tube is also supported by pedestals which extend radially from the housing to the first tube second end. The open second end of the first tube is in open communication with the housing.

The second tube presents open first and second ends, and is positioned within the first tube. The second tube first end is supported by pedestals extending radially from the first tube first end to the second tube first end. The open first end of the second tube is in open communication with the first tube. The second tube second end is coupled with the second end plate adjacent the second end plate opening.

During operation of the prior art device, the material flows along the flow path through the housing and tubes, and is ejected through the outlet. When introduced, the material is moist and relatively supple. As a result, the material is susceptible to becoming wrapped around structures along the material flow path, thus clogging, or otherwise restricting, the material flow path.

A portion of the material strikes the internal structures, such as the pedestals, and wraps around the pedestals and the other structures. This problem is especially noticed at the points where the material exits the housing and enters the first tube, and where the material exits the first tube and enters the second tube. At these points, the material is required to make a 180° turn, which causes the material velocity to decrease, a factor which further aids in the material becoming wrapped around the structures.

As the portion of wrapped material grows, the flow path becomes increasingly restricted. As a result, the dryer operates at a reduced efficiency, and must be eventually opened and cleaned. Therefore, a significant, and heretofore unsolved, need exists to provide a rotary drum dryer having improved structure which prevents the material flow path from becoming clogged, or otherwise restricted, during operation.

SUMMARY OF THE INVENTION

The present invention addresses the prior art problems discussed above and provides a distinct advance in the state of the art. More particularly, the rotary drum dryer hereof includes structure for positioning the dryer tubes concentrically within the housing which prevents material from becoming clogged along the flow path.

The preferred rotary drum dryer broadly includes a tubular housing having sidewalls and presenting opposed, first and second ends, and means for rotating the housing. The housing includes an inlet for receiving inlet gas and for receiving strands of material. The inlet gas may be heated.

The housing further includes a first tube received within the housing, a second tube received within the first tube, a first end plate mounted to one end of the first tube, and a second end plate mounted to the second end of the housing. The second end plate includes an opening. The first tube is positioned within the housing by having the end of the first tube adjacent the first end plate supported by a plurality of gussets extending from the housing wall to the first tube, and by having the other end of the first tube being coupled with the second end plate.

One end of the second tube is coupled with the first end plate, and the other end of the second tube is open and is coupled with the second end plate adjacent the opening. The open end defines an outlet for the material and the gas.

A plurality of apertures are defined in each of the first and second tubes so that the mixture of gas and material is allowed to flow through the housing, into and through the first tube, into and through the second tube, and to the outlet. The apertures have length and width dimensions which are greater than the length of the strands of material. Filler flights having an outer periphery presenting a periphery length are positioned between adjacent ones of the apertures. The periphery length is greater than the length of the strands of material.

As the material passes through the dryer, it is unable to become stuck or hung up on any of the internal structural members. Therefore, the material flow path through the rotary drum dryer of the present invention does not become restricted as in the prior art, and the dryer operates at a greater efficiency, and requires less frequent cleaning than the prior art.

The housing and the first tube include lifting flights which are respectively provided adjacent the first tube and second tube apertures. As the housing rotates, the lifting flights agitate the material so that the material keeps moving along the flow path through the dryer.

The housing also includes means for allowing the tubes to expand longitudinally. Expansion of the tube lengths is necessary to compensate for the expansion and contraction of the tubes due to the change in the temperature of the tubes as the heated gas travels along the flow path.

DESCRIPTION OF THE DRAWING FIGURES

DETAILED DESCRIPTION OF THE PREFERRED EMBODIMENT

Figure 1:
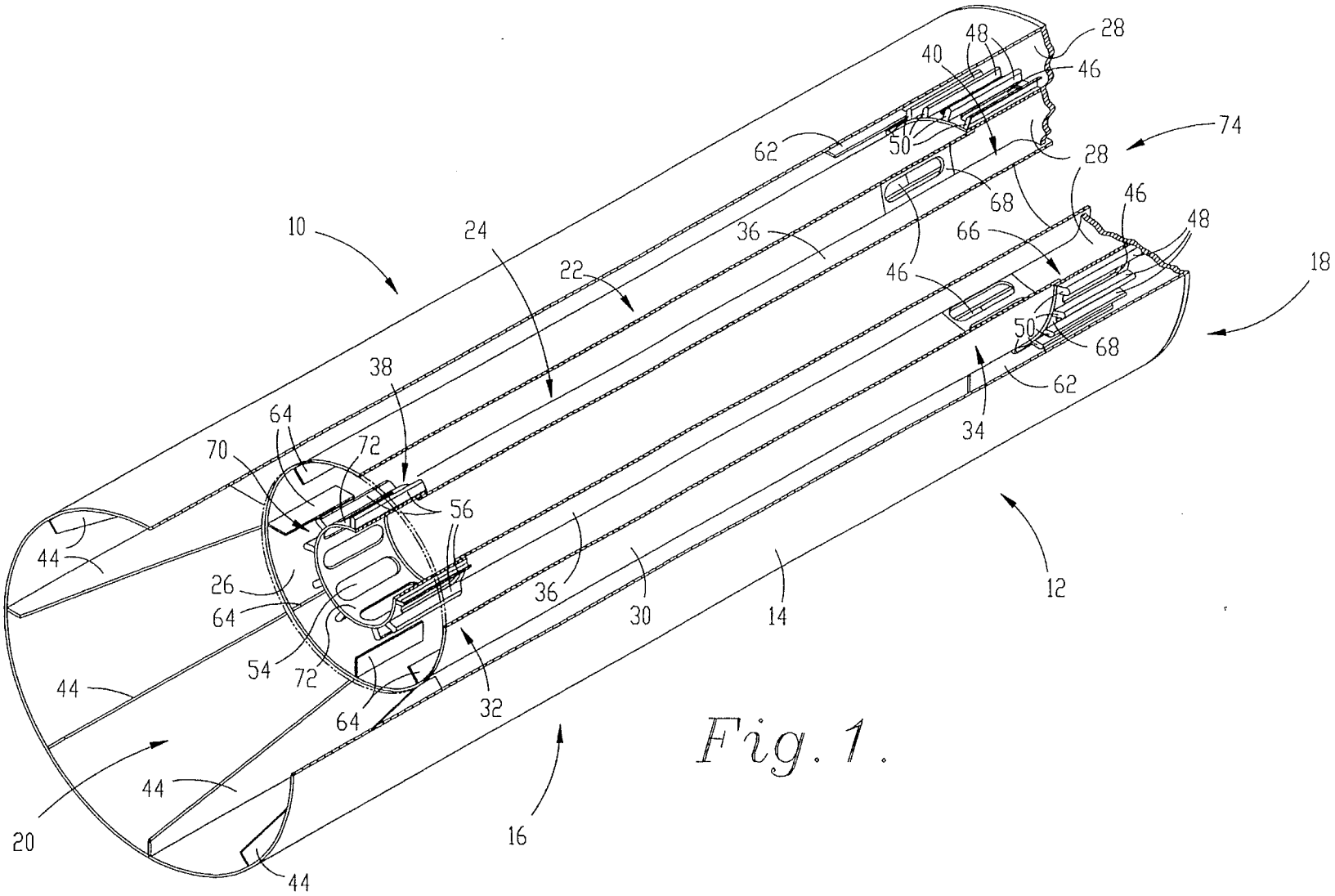
FIG. 1 is a cut-a-way perspective view of a rotary drum dryer.

Referring now to FIG. 1, preferred embodiment 10 of a rotary drum dryer broadly includes tubular housing 12 having sidewall 14 and presenting opposed, first and second ends 16 and 18, and means for rotating housing 12. Inlet 20 is provided adjacent housing first end 16 for receiving inlet gas and for receiving moist material to be dried.

The inlet gas is preferably heated, and may be supplied by a furnace or other suitable source. The material may be an agricultural product, such as soybean meal, and it may include elongated strands, such as wheat straw, long strand alfalfa, and wood seltzer, strains, ribbon & wafers.

Housing 12 further includes first tube 22 received within housing 12, second tube 24 received within first tube 22, first end plate 26, and second end plate 28 which is coupled with housing 12 adjacent housing second end 18. Second end plate 28 may be welded to housing 12, or it may be coupled with housing 12 by any other suitable means, such as by rivets or bolts.

Figure 3:
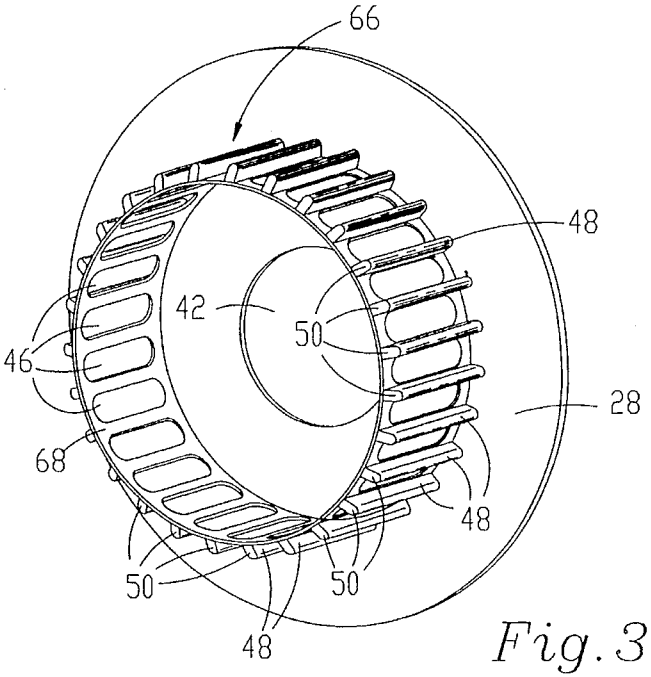
FIG. 3 is a perspective view of an apertured support sleeve having filler flights coupled with a second end plate of the dryer.

First tube 22 presents sidewall 30 and includes opposed, first and second ends 32 and 34. Second tube 24 presents sidewall 36, and includes opposed, first and second ends 38 and 40. Opening 42 is defined in second end plate 28, as shown in FIG. 3.

Referring back to FIG. 1, first tube 22 is positioned within housing 12, and second tube 24 is positioned within first tube 22. A plurality of support gussets 44 are provided in housing 12 and extend radially inward from sidewall 14 to support first end 32 of first tube 22.

Second end 34 of first tube 22 is slidably received within support sleeve 66 having sidewall 68. Support sleeve 66 is coupled with second end plate 28, such as by being welded to second end plate 28, or by any other suitable means, such as by rivets or bolts. First end plate 26 is coupled with first end 32 of first tube 22. First end plate 26 may be welded to first tube first end 32, or it may be coupled by any other suitable means, such as rivets, or bolts.

First end 38 of second tube 24 is slidably received by support sleeve 70 having sidewall 72. Support sleeve 70 is coupled with first end plate 26, such as by being welded to first end plate 26, or by any other suitable means, such as rivets or bolts.

Second tube second end 40 is coupled with second end plate 28 adjacent opening 42. Second tube second end 40 may be welded to second end plate 28, or it may be coupled with second end plate by any other suitable means, such as rivets, or bolts. Second tube second end is open and defines outlet 74. Although second tube second end 40 is depicted as protruding from second end plate 28 through opening 42, it may alternatively be flush with second end plate 28.

A plurality of spaced apertures 46 are defined through sidewall 68 around support sleeve 66. Apertures 46 define length and width dimensions. The length and width dimensions of apertures 46 are greater than the length of the strands of material.

Figure 4:
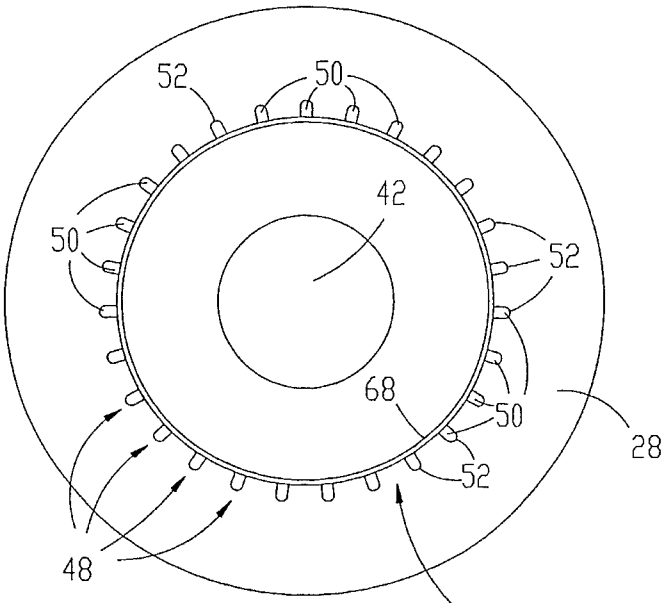
FIG. 4 is an end view of the support sleeve of FIG. 3.

A plurality of filler flights 48 having angled front face 50 are mounted on support sleeve 66 between adjacent ones of apertures 46. As depicted in FIG. 4, filler flights 48 include outer periphery 52 presenting a periphery length. The periphery length of filler flights 48 is greater than the length of the elongated strands of material.

A plurality of spaced apertures 54 are defined through sidewall 72 around support sleeve 70, as shown in FIG. 1. Apertures 54 define length and width dimensions, and are substantially similar to apertures 46. The length and width dimensions of apertures 54 are greater than the length of the strands of material.

Figure 5:
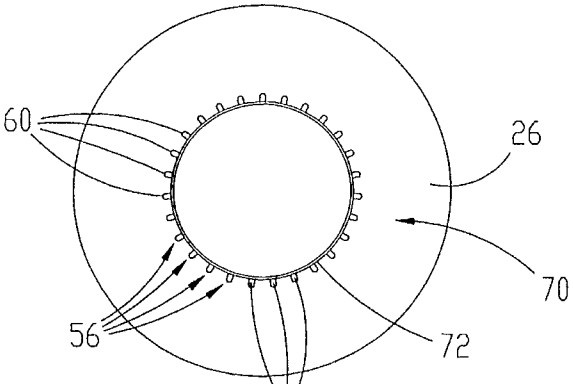
FIG. 5 is an end view of an apertured support sleeve coupled with a first end plate of the dryer.

Referring now to FIG. 5, a plurality of filler flights 56 having angled front face 58 are mounted on support sleeve 70 between adjacent ones of apertures 54. Filler flights 56 are substantially similar to filler flights 48. Filler flights 56 include outer periphery 60 presenting a periphery length. The periphery length is greater than the length of the strands of material.

Figure 2:
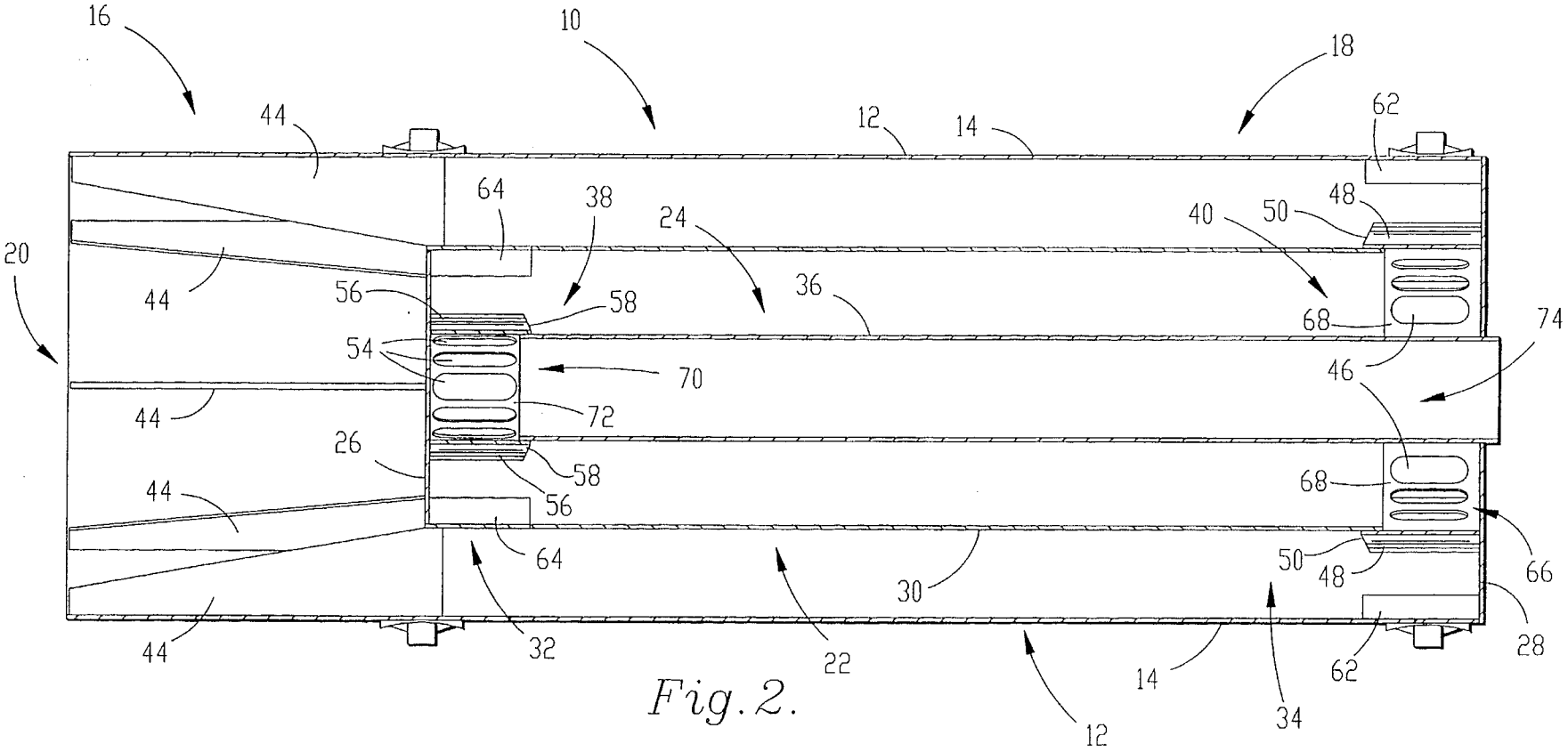
FIG. 2 is an elevational view of the dryer of FIG. 1.

Housing 12 includes a plurality of lifting flights 62 mounted on housing second end 18 adjacent first tube apertures 46, as shown in FIG. 2. First tube 22 includes a plurality of lifting flights 64 mounted on first tube first end 32 adjacent second tube apertures 54.

In operation, housing 12, and tubes 22 and 24 are in rotary motion while a continuous mixture of inlet gas and material is injected into housing 12 through inlet 20. The material may include elongated strands presenting a length of 10 inches, however, materials having other lengths may alternatively be used. The material passes through housing 12 and is directed towards housing second end 18 as a result of the force exerted on the material by the inlet gas. At this point, the material attempts to pass through apertures 46.

A portion of material will strike the portion between apertures 46, and not enter first tube 22. It will be appreciated, however, that the material which does not pass into first tube 22 will not be allowed to wrap itself around any of filler flights 48 since the periphery length is greater than the length of the material.

Material which strikes filler flights 48 and does not enter first tube 22 will either fall onto housing sidewall 14 adjacent lifting flights 62, or it will be carried by filler flights 48 over the top as first tube 22 rotates until the material falls under the weight of gravity back to housing sidewall 14 adjacent lifting flights 62. Lifting flights 62 agitate the material so that the material is again directed towards apertures 46. This process continues until the material enters first tube 22 through apertures 46.

Next, the material is directed along first tube 22 towards first tube first end 32. The volume of first tube 22 is smaller than the volume of housing 12, therefore, the velocity of the material is greater within first tube 22 than when the material passes through housing 12. Once the material reaches first tube first end 38, it is directed towards apertures 54.

Similar to the material which strikes filler flights 48, material which strikes filler flights 56 either falls under the weight of gravity onto first tube sidewall 30 adjacent lifting flights 64, or it is carried by filler flights 56 over the top as second tube 24 rotates until the material falls onto sidewall 30 adjacent lifting flights 64.

The velocity of the material while passing through second tube 24 is greater than the velocity of the material while passing through first tube 22. Once the material enters second tube 24, it is directed towards outlet 74 and is thus ejected from housing 12. It will be appreciated that as the material passes through housing 12 and tubes 22 and 24, the heated gas dries the material.

Although the rotary drum dryer has been described with reference to illustrated preferred embodiment 10, it is noted that variations and changes may made and equivalents employed without departing from the scope of the invention as recited in the claims. For example, apertures 46 and apertures 54 are depicted as being elongated with rounded corners. They may alternatively have angular corners, and they may also have other shapes provided that they present dimensions which are greater than the length of the strands of material.

First and second tubes 22 and 24 are concentrically positioned within housing 12. Tubes 22 and 24 may alternatively be non-concentric. Housing 12, and tubes 22 and 24 may have shapes other than that of a cylinder. However, due to the rotational motion of housing 12 and tubes 22 and 24, the dryer must be dynamically sufficiently balanced so that it does not become unstable during operation, or suffer from stress failure.

Filler flights 48 and 56 have respective outer peripheries 52 and 60 which are bowed. Peripheries 52 and 60 may have any of various shapes, for instance, they may be triangular, or rectangular, however, the periphery length must be greater than the length of the strands of material.

Lifting flights 62 and 64 have a rectangular shape. They may alternatively have other shapes and sizes which are sufficient to agitate the material in order to keep the material traveling along the flow path through housing 12 and tubes 22 and 24.

What is claimed is:

1. A rotary drum dryer comprising:

a housing presenting opposed, first and second ends; and means for rotating said housing;

said housing including means for receiving inlet gas from a source thereof, and for discharging exhaust gas from said housing, means for receiving material including elongated strands from a source thereof, and for discharging said material from said housing, a first tube having sidewalls and presenting opposed, first and second ends, a second tube having sidewalls and presenting opposed, first and second end, means for positioning said second tube within said first tube and coupling said tubes adjacent said respective first and second ends thereof without any intervening connections between said first and second tubes along said tube sidewalls, said second tube including means defining a plurality of apertures through said second tube sidewall adjacent said second end thereof for passage of material between said tubes, each of said apertures presenting a length dimension and a width dimension, said length and width dimensions being greater than the length of the strands of material; and at least one filler flight positioned between adjacent ones of said second tube apertures.

2. The rotary drum dryer as set forth in claim 1, said material including elongated strands, said aperture presenting a dimension thereacross, said dimension being greater than the length of the strands of material.

3. The rotary drum dryer as set forth in claim 1, said material including elongated strands, said aperture presenting a length dimension and a width dimension, said length and width dimensions being greater than the length of the strands of material.

4. The rotary drum dryer as set forth in claim 1, said filler flight including an outer periphery presenting a periphery length, said periphery length being greater than the length of the strands of material.

5. The rotary drum dryer as set forth in claim 1, said first tube including at least one lifting flight mounted within said first tube adjacent said aperture.

6. The rotary drum dryer as set forth in claim 1, said housing further including means for positioning said first tube within said housing.

7. The rotary drum dryer as set forth in claim 6, said housing including a first end plate and a second end plate, said second end plate having an opening defined therein, said first tube positioning means including, means for supporting said first end of said first tube, means for coupling said second end plate with said housing adjacent said second end thereof, and means for coupling said second end of said first tube with said second end plate.

8. The rotary drum dryer as set forth in claim 7, said second tube positioning means including means for coupling said first end plate with said first tube adjacent said first end thereof, means for coupling said first end of said second tube with said first end plate, and means for coupling said second end of said second tube with said second end plate adjacent said opening.

9. The rotary drum dryer as set forth in claim 8, said first tube including means defining at least one aperture through said first tube sidewall adjacent said second end thereof for passage of material between said housing and said first tube.

10. The rotary drum dryer as set forth in claim 9, said material including elongated strands, said first tube aperture presenting a dimension thereacross, said dimension being greater than the length of the strands of material.

11. The rotary drum dryer as set forth in claim 9, said material including elongated strands, said first tube aperture presenting a length dimension and a width dimension, said length and width dimensions being greater than the length of the strands of material.

12. The rotary drum dryer as set forth in claim 9, said housing including at least one lifting flight mounted within said housing adjacent said second tube aperture.

13. The rotary drum dryer as set forth in claim 8, said material including elongated strands, said first tube including structure defining a plurality of said apertures through said first tube sidewall adjacent said first end thereof, each of said apertures presenting a length dimension and a width dimension, said length and width dimensions being greater than the length of the strands of material, and at least one filler flight positioned between adjacent ones of said first tube apertures.

14. The rotary drum dryer as set forth in claim 13, said filler flight including an outer periphery presenting a periphery length, said periphery length being greater than the length of the strands of material.

15. A rotary drum dryer comprising:

a tubular housing presenting opposed, first and second ends, said housing including means defining an inlet; and means for rotating said housing;

said housing including a first tube having sidewalls and presenting opposed, first and second ends, a second tube having sidewalls, and presenting opposed, first and second ends, a first end plate, a second end plate having an opening defined therethrough, means for positioning said first tube within said housing, said first tube positioning means including, means for supporting said first end of said first tube within said housing, means for coupling said second end plate with said housing adjacent said second end thereof, and means for coupling said first tube second end with said second end plate, and without any intervening connections between said housing and said first tube along said first tube sidewalls, and means for positioning said second tube within said first tube, said second tube positioning means including, means for coupling said first end plate with said first tube adjacent said first end thereof, means for coupling said first end plate with said first end of said second tube, and means for coupling said second end of said second tube with said second end plate adjacent said opening, and without any intervening connections between said first and second tubes along said tube sidewalls, said first tube including means defining a plurality of apertures through said first tube sidewall and spaced therearound adjacent said second end thereof for passage of material between said housing and said first tube during rotation of said housing, said second tube including means defining a plurality of apertures through said second tube sidewall and spaced therearound adjacent said second end thereof for passage of material between said first tube and said second tube during rotation of said housing, and means defining an outlet from said second tube, said housing, tubes, and end plates cooperably defining a material flow path from said inlet, through said housing, said first tube apertures, said first tube, said second tube apertures, and said second tube to said outlet.

16. The rotary drum dryer as set forth in claim 15, said first tube including at least one filler flight mounted between adjacent ones of said first tube apertures, said second tube including at least one filler flight mounted between adjacent ones of said second tube apertures, said filler flights including an outer periphery presenting a periphery length, said periphery length being greater than the length of the strands of material.

17. The rotary drum dryer as set forth in claim 15, said housing including at least one lifting flight mounted within said housing adjacent said first tube aperture, said first tube including at least one lifting flight mounted within said tube adjacent said second tube aperture.

18. A rotary drum dryer comprising:

a housing presenting opposed, first and second ends; and means for rotating said housing;

said housing including means for receiving inlet gas from a source thereof, and for discharging exhaust gas from said housing, means for receiving material from a source thereof, and for discharging said material from said housing, a first tube having sidewalls and presenting opposed, first and second ends, a second tube having sidewalls and presenting opposed, first and second ends, and means for positioning said second tube within said first tube and coupling said tubes adjacent said respective first and second ends thereof without any intervening connections between said first and second tubes along said tube sidewalls, said second tube including means defining at least one aperture through said second tube sidewall adjacent one of said ends thereof for passage of material between said tubes, said first tube including at least one lifting flight mounted within said first tube adjacent said aperture.

19. A rotary drum dryer comprising:

a housing presenting opposed, first and second ends; and means for rotating said housing;

said housing including means for receiving inlet gas from a source thereof, and for discharging exhaust gas from said housing, means for receiving material from a source thereof, and for discharging said material from said housing, a first tube having sidewalls and presenting opposed, first and second ends, a second tube having sidewalls and presenting opposed, first and second ends, and means for positioning said second tube within said first tube and coupling said tubes adjacent said respective first and second ends thereof without any intervening connections between said first and second tubes along said tube sidewalls, said second tube including means defining at least one aperture through said second tube sidewall adjacent one of said ends thereof for passage of material between said tubes, said housing further including means for positioning said first tube within said housing, the housing having a first end plate and a second end plate, the second end plate having an opening defined therein, said tube positioning means including means for supporting said first end of said first tube, means for coupling said second end plate with said housing adjacent said second end thereof, and means for coupling said second end of said first tube with said second end plate.

* * * * *